United States Patent [19]

Ishida et al.

[11] Patent Number: 5,007,240

[45] Date of Patent: Apr. 16, 1991

[54] HYBRID RANKINE CYCLE SYSTEM

[75] Inventors: Tetsuyoshi Ishida; Shigeyoshi Kawano, both of Kure; Ikuo Kohtaka, Kamo; Kojiro Yamada; Hiroyuki Kaku, both of Hiroshima; Tsuneo Narita, Tokyo, all of Japan

[73] Assignee: Babcock-Hitachi Kabushiki Kaisha, Tokyo, Japan

[21] Appl. No.: 308,812

[22] Filed: Feb. 9, 1989

[30] Foreign Application Priority Data

| | | | |
|---|---|---|---|
| Dec. 18, 1987 | [JP] | Japan | 62-320579 |
| Feb. 12, 1988 | [JP] | Japan | 63-30648 |
| Mar. 24, 1988 | [JP] | Japan | 63-70438 |
| Mar. 24, 1988 | [JP] | Japan | 63-70440 |

[51] Int. Cl.[5] ..... F01K 25/06

[52] U.S. Cl. ..... 60/673; 60/649

[58] Field of Search ..... 60/649, 673

[56] References Cited

U.S. PATENT DOCUMENTS 4,442,677 4/1984 Kauffman ..... 60/673

4,481,775 11/1984 Bevridge ..... 60/673 X

FOREIGN PATENT DOCUMENTS 29690 of 1897 United Kingdom ..... 60/673

294882 9/1929 United Kingdom ..... 60/673

*Primary Examiner*—Allen M. Ostrager

*Attorney, Agent, or Firm*—Antonelli, Terry, Stout & Kraus

[57] ABSTRACT

A hybrid Rankine cycle system comprises a boiler in which water steam is generated, a steam turbine which is worked by the water steam from the boiler to drive a generator to obtain an electric power, an absorber condenser for introducing thereinto strong absorbent solution to absorb the water steam from the steam turbine to produce weak absorbent solution, and a pump for delivering the weak absorbent solution from the absorber condenser to the boiler. The weak absorbent solution is heated in the boiler to produce the strong absorbent solution to be fed to the absorber condenser and the water steam to be fed to the steam turbine.

8 Claims, 12 Drawing Sheets

HYBRID RANKINE CYCLE SYSTEM

BACKGROUND OF THE INVENTION

The present invention relates to a hybrid Rankine cycle system.

A typical power plant incorporating a Rankine cycle system basically has a boiler B, a steam turbine ST, a condenser C and a feedwater pump FP. The boiler B is generally equipped with a superheater SH.

The boiler B heats a working medium or water to generate vapor or steam. The saturated steam of high temperature and pressure generated in the boiler B flows into a superheater SH and is superheated to become superheated steam of higher temperature. The high-pressure steam from the superheater SH expands through the steam turbine ST to produce mechanical work, and is then discharged with relatively lower temperature and pressure. The mechanical work thus produced in the steam turbine ST is converted into electrical power by means of a generator G connected to the steam turbine ST. The steam from the steam turbine ST passes through the condenser, where it condenses into condensate CD on heat exchange with cooling water CW supplied from the outside. The condensate CD from the condenser C is pumped by a feedwater pump FP to the boiler B to complete the cycle.

In general, the thermal efficiency $\eta$ of the power plant gauges the extent to which the energy input to the working fluid flowing through the boiler is converted to the net work output. Thus, in a basic cycle, the thermal efficiency $\eta$ is represented by the following formula:

$$\eta=(W_{turbine}-W_{pump})/Q\text{input}$$

where, $W_{turbine}$ represents the work done outside by the steam turbine ST, $W_{pump}$ represents the work input to the feedwater pump FP and $Q_{input}$ represents the energy input to the boiler.

The following two ways can be available for improving the thermal efficiency:

(1) Increase temperature and pressure of steam to be supplied to the steam turbine ST, and (2) Reduce temperature and pressure of the steam discharged from the steam turbine ST.

Referring to the first method, the maximum temperature and pressure are limited to be between 811° K and 839° K and to be not higher than $2.46\times10^2$ Pa, respectively, in the technical point of view of heat resisting strength of the boiler material. Accordingly, it is difficult to expect the further improvement in the thermal efficiency due to increase in the temperature and pressure.

The temperature and pressure of the steam discharged from the steam turbine depends on the temperature of the cooling water CW. In general, the pressure of the steam from the steam turbine corresponds to a saturation pressure of steam at a temperature higher by 5° C. to 10° C. than that of the cooling water CW. The temperature of the steam from the steam turbine corresponds to a temperature to which the steam passing into the steam turbine reaches when such steam expands to reduce the pressure thereof into that of the steam leaving the steam turbine. In consequence, the improvement in the thermal efficiency by the second method requires cooling water of a lower temperature and, hence, is limited undesirably.

On the other hand, a Karina cycle is known which does not require cooling water of low temperature. The Karina cycle makes use of ammonia as a working medium for a vapor prime mover. The working medium (ammonia) is absorbed by water so that the temperature and pressure of vapor from the prime mover are lowered. The Karina cycle, however, requires various additional safety measures because of combustibility and toxicity of ammonia. Ammonia of 0.5%–1% concentration in terms of volumetric ratio causes a fatal effect within 30 minutes. Thus, the Karina cycle is not suitable to practically carry out and requires a complicated arrangement.

OBJECT AND SUMMARY OF THE INVENTION

Accordingly, an object of the present invention is to provide a hybrid Rankine cycle system which overcomes the above-described problems of the prior art.

More specifically, the present invention is aimed at providing a hybrid Rankine cycle system which offers a sufficiently high thermal efficiency and which has a simple construction.

To this end, according to the present invention, there is provided a hybrid Rankine cycle system comprising:

means including a heating device and for separating working medium vapor from a weak absorbent solution including said working medium and a substance having boiling point higher than the heating temperature in the heating device, whereby the substance may remain therein as a strong absorbent solution;

a vapor driven prime mover through which said vapor from the vapor separating means expands to produce work outside;

an absorber condenser means for introducing thereinto the strong absorbent solution to absorb the vapor from the prime mover to produce the weak absorbent solution;

means for delivering the weak absorbent solution towards the vapor separating means; and means for delivering the strong absorbent solution from the separating means towards the absorber condenser means.

In the hybrid Rankine cycle system according to the present invention, a condensed strong absorbent solution is produced by a working medium vapor separation means such as a boiler or a regenerator. The condensed strong absorbent solution is supplied to an absorber condenser where the working medium vapor from the prime mover is absorbed by the strong absorbent solution and condensed to become a condensate.

DESCRIPTION OF THE PREFERRED EMBODIMENTS

Figure 1:
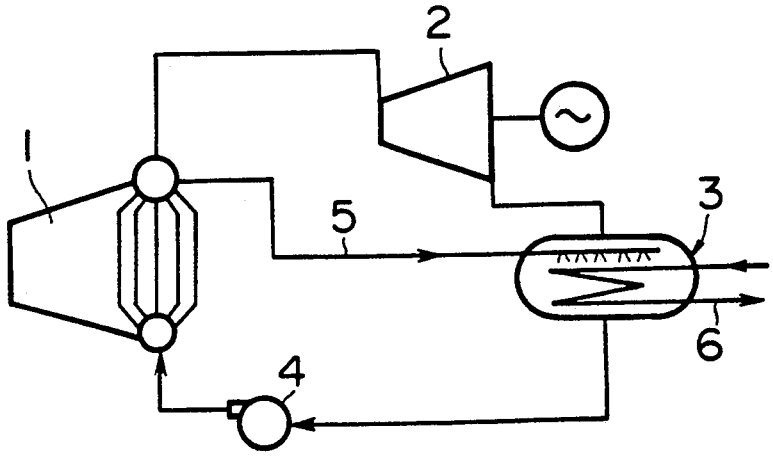
FIG. 1 is a block diagram of an embodiment of the hybrid Rankine cycle system in accordance with the present invention.

Referring to FIG. 1, an embodiment of the hybrid Rankine cycle system in accordance with the present invention basically has a boiler 1, a vapor prime mover 2, an absorber condenser 3 and a feed pump 4. The boiler 1 may have a superheater.

An absorbent solution is supplied to the boiler 1 by the feed pump 4 and is heated therein to free vapor of a working medium from the absorbent solution, which vapor has been absorbed by this absorbent solution. In consequence, an absorbent solution of a high concentration (referred to as "strong absorbent solution" hereinafter) remains in the boiler 1. The vapor leaving the boiler flows into the prime mover 2 and expand therethrough to produce mechanical work, and discharged with relatively low temperature and pressure into the absorber condenser 3. An outlet of the boiler 1 is communicated with the absorber condenser 3 through a communication line 5 through which the strong absorbent solution flows. The vapor from the prime mover 2 makes gas-liquid contact with the strong absorbent solution from the boiler 1. Namely, the strong absorbent solution leaving the boiler 1 absorbs the working medium vapor to become an absorbent solution of a low concentration (referred to as "weak absorbent solution" hereinafter). Absorption heat generated is discharged to the cooling water flowing the cooling water line 6. The weak absorbent solution is discharged from the absorber condenser 3 and is then returned to the boiler 1 by means of the feed pump 4.

The working medium and the absorbent should be selected such that they do not easily mix with each other when the absorbent solution is in boiled condition. Preferably, the absorbent solution should have the following characteristics:

(1) Large absorptivity,
(2) Large chemical stability,
(3) Low viscosity and high heat conductivity,
(4) No toxicity and poor inflammability and explosiveness.

Thus, a water-lithium bromide (LiBr) solution, a water-lithium chloride (LiCl) solution or a water-potassium hydroxide (KOH) solution is suitably used as the absorbent solution.

When water-lithium bromide solution is used as the absorbent solution, the working medium which works in the prime mover 2 is steam, while the absorbent solution is an aqueous solution of lithium bromide.

Figure 2:
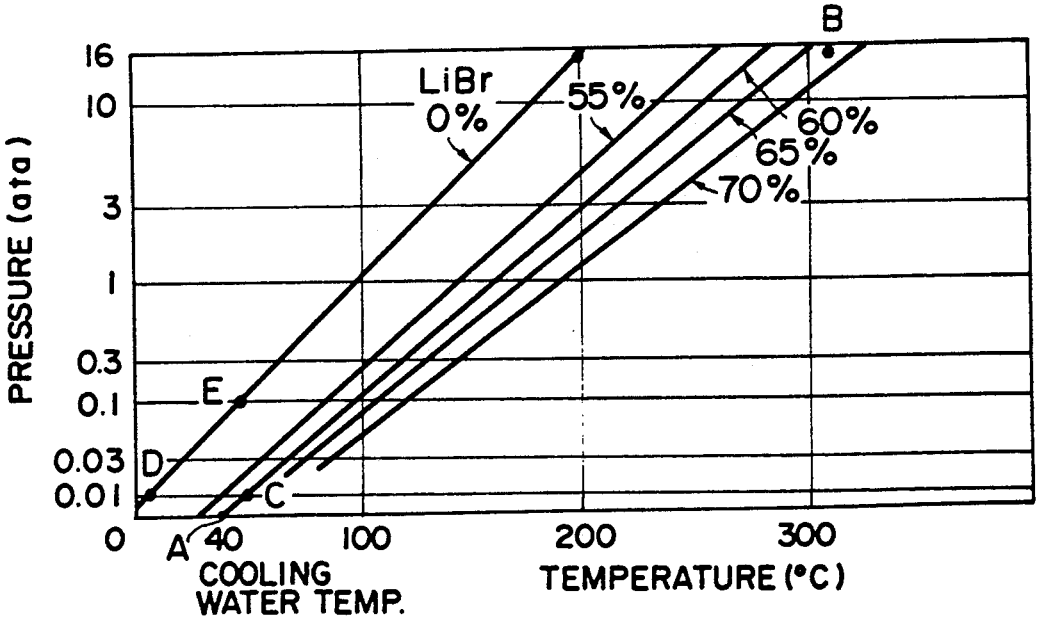
FIG. 2 is a Dühring's diagram of an LiBr solution used in the embodiment shown in FIG. 1.

FIG. 2 shows a Dühring's diagram of aqueous solution of lithium bromide. It will be seen that the higher the saturation temperature of aqueous solution of lithium bromide becomes, the higher the concentration of lithium bromide becomes. The absorbent solution flowing from the condenser 3 towards the boiler 1 is a weak aqueous solution of lithium bromide, while the absorbent solution flowing in the communication line 5 is a strong lithium bromide aqueous solution.

It is assumed that the pressure in the boiler is 16 ata, the temperature of the cooling water is 40° C., and the concentrations of the lithium bromide in the weak lithium bromide aqueous solution and in the strong lithium bromide aqueous solution are 59% and 678%, respectively (point A). Under these conditions, the pressure within the condenser 3 becomes to a pressure in point C, i.e., 0.01 ata, which corresponds to lithium bromide concentration of 59% and temperature of $40°+\alpha$.

Figure 3:
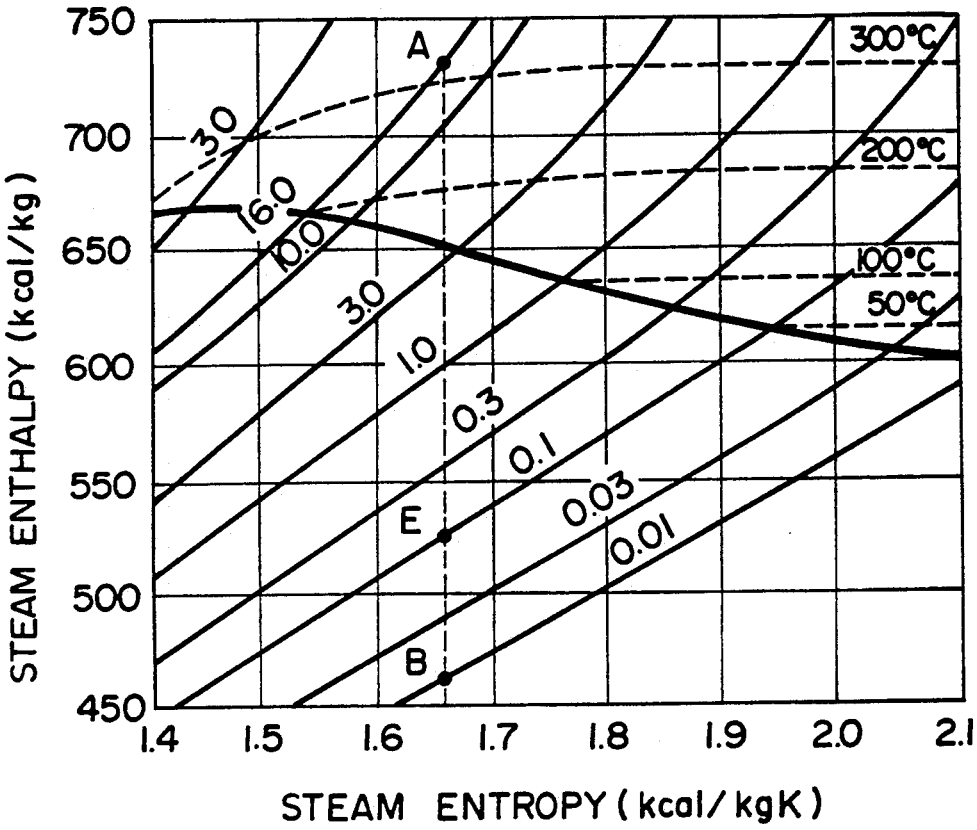
FIG. 3 is an Enthalpy-Entropy diagram of steam.

The temperature and pressure of the steam generated in the boiler 1 and of the strong lithium bromide are 310° C. and 16 ata, respectively, as shown at point B in FIG. 2. The steam of 310° C. and 16 ata adiabatically expands in the prime mover 2 to reduce the pressure thereof into 0.01 ata. If the expansion is a perfectly adiabatic one, the steam temperature and pressure are reduced to 7° C. and 0.01 ata, respectively, as shown at point B in FIG. 3. In such a case, the enthalpies of the steam at the inlet and the outlet of the prime mover 2 are 730 Kcal/kg (point A in FIG. 3) and 465 Kcal/kg (point B in FIG. 3), respectively. In consequence, the prime mover 2 produces an output of 265 Kcal per 1 kg of steam per unit time.

Figure 4:
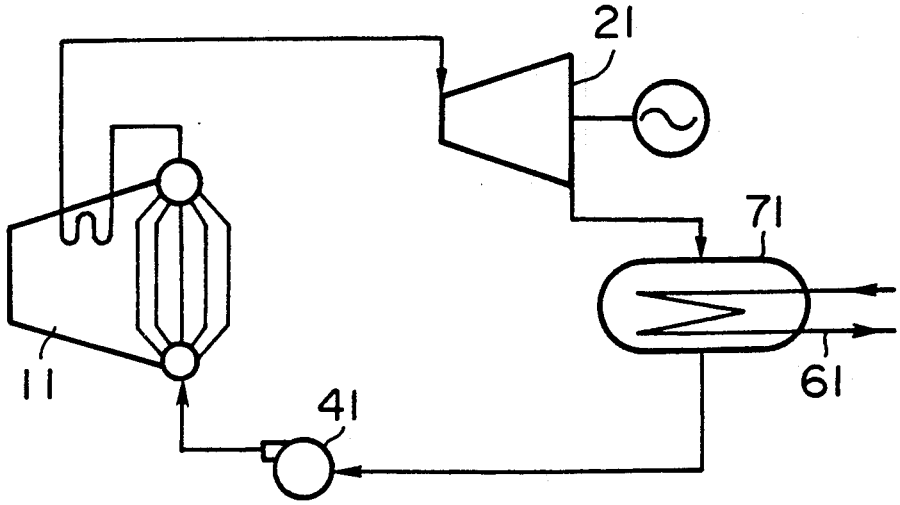
FIG. 4 PRIOR ART
FIGS. 4 and 5 are block diagrams of a conventional Rankine cycle system and a Karina cycle system, respectively.

Referring now to a conventional Rankine cycle system shown in FIG. 4, assuming that the temperature and the pressure of the steam leaving the boiler 11 are 310° C. and 16 ata and that the temperature of the cooling water circulated through the condenser 71 is 40° C., the pressure in the condenser 71 is 0.12 ata (saturation temperature 50° C.). The enthalpies of the steam at the inlet and the outlet of the prime mover 21 are 730 Kcal/kg (point A in FIG. 3) and 530 Kcal/kg (point E in FIG. 3), respectively. Accordingly, the output of the prime mover 21 per 1 kg of steam per unit time is 200 Kcal.

As will be understood from the foregoing description, the described embodiment can produce the output of 265 Kcal/kg per 1 kg of steam which is much higher than 200 Kcal/kg produced by conventional Rankine cycle system, thus achieving a remarkable improvement in the thermal efficiency. In addition, the described embodiment can produce superheated steam without provision of a superheater. The conventional Rankine cycle system has required that the system during a start-up time period has to be operated with a light thermal load until the flow rate of steam in a superheater of the boiler is increased to a level large enough to prevent melting down of the superheater. Such light-load operation is not necessary in the hybrid Rankine cycle system of the described embodiment. Thus, the described embodiment is also advantageous in that the start-up time period can be shortened considerably.

Figure 5:
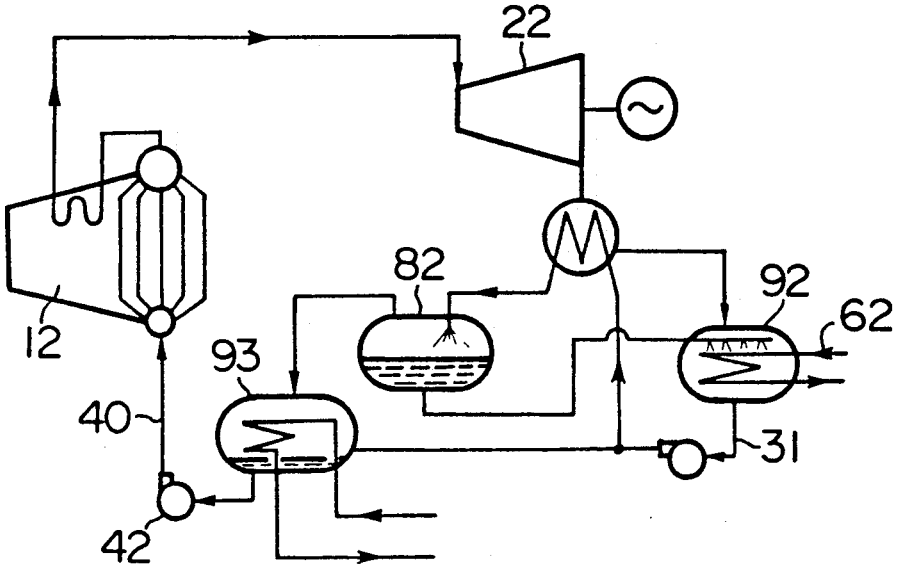
FIG. 5 PRIOR ART

As shown in FIG. 5, a conventional Karina cycle system which makes use of a mixture fluid consisting of ammonia and water employs a flash tank 82 which conducts flashing of the mixture of aqueous ammonia and ammonia gas so as to separate the mixture into two fractions: namely, aqueous ammonia of a low concentration (weak aqueous ammonia) and a mixture of ammonia gas and steam. The weak aqueous ammonia flows into the absorber condenser 92 and absorbs therein the ammonia gas leaving the prime mover 22. On the other hand, the mixture of ammonia gas and steam from the flash tank 82 flows into the condenser 93 and condenses therein into an ammonia condensate of a high concentration (strong ammonia condensate).

It will be seen that the described embodiment is much simpler in construction than the Karina cycle system shown in FIG. 5. In addition, a higher safety is ensured due to the elimination of use of ammonia which has a high toxicity.

Figure 6:
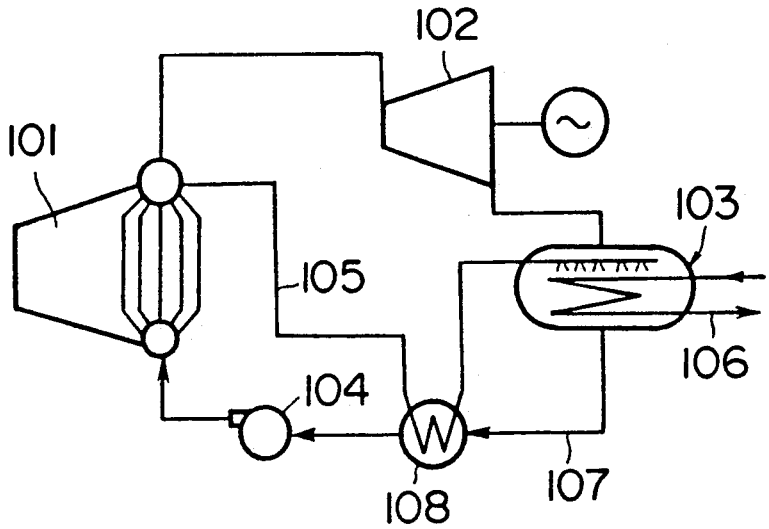
FIGS. 6 and 8 are block diagrams of different embodiments.

In a different embodiment of the present invention shown in FIG. 6, heat exchange is conducted between the weak absorbent solution to be supplied to the boiler 101 and the strong absorbent solution leaving the boiler 101. To this end, a communication line 105 through which the strong absorbent solution passes crosses the returning line 107 through which the weak absorbent solution passes through a heat exchanger 108. The temperature of the weak absorbent solution to be supplied to the boiler 101, which is as low as 50° C. in the first embodiment, can be pre-heated up to about 250° C. by virtue of the heat exchanger 108. This decreases the demand for heat input to the boiler 101, thus contributing to an improvement in the thermal efficiency of the system.

Table 1 shows the performance of two embodiments of the invention, i.e., a hybrid Rankine cycle without a heat exchanger (FIG. 1) and a hybrid Rankine cycle with a heat exchanger (FIG. 6), in comparison with the performance of the conventional Rankine cycle system.

TABLE 1

Figure 7:
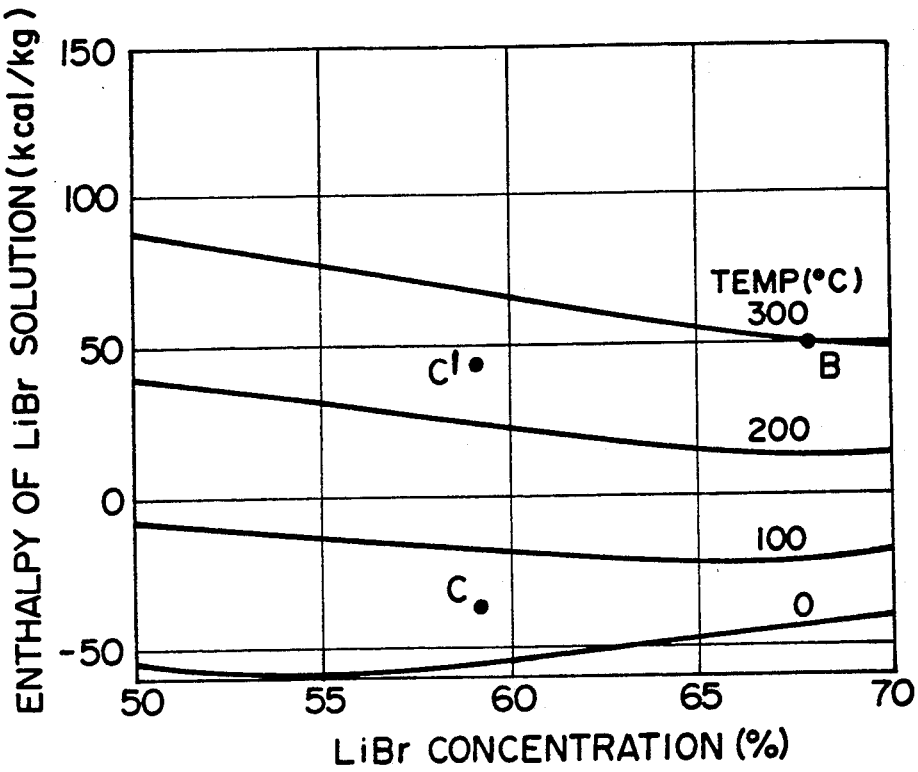
FIG. 7 is an Enthalpy-Concentration diagram of LiBr solution.

| Items | Types of cycle: Rankine cycle (conventional) | Hybrid Rankine cycle: Without heat exchanger (invention) | Hybrid Rankine cycle: With heat exchanger (invention) | Remarks |
|---|---|---|---|---|
| Boiler steam pressure (ata) | 16 | 16 | 16 | |
| Boiler temperature (°C.) | 310 | 310 | 310 | |
| Condenser pressure (ata) | 0.1 | 0.01 | 0.01 | FIG. 2, point E, C |
| Condenser outlet fluid temperature (°C.) | 50 | 50 | 50 | |
| Prime mover outlet steam temperature (°C.) | 50 | 7 | 7 | FIG. 3, point E, B |
| Prime mover outlet steam enthalpy | | | | |
| Inlet (Kcal/kg) | 730 | 730 | 730 | FIG. 3, point A |
| Outlet (Kcal/kg) | 530 | 465 | 465 | FIG. 3, point E, B |
| Vapor engine output/steam | 730 − 530 = 200 | 730 − 465 = 265 | 265 | |
| Boiler inlet water temperature (°C.) | 50 | — | — | |
| Boiler inlet LiBr solution temperature (°C.) | — | 50 | 250 | |
| Boiler outlet LiBr solution flow rate/steam flow rate | — | 6.56 | 6.56 | |
| Boiler inlet water enthalpy (Kcal/kg) | 50 | — | — | |
| Boiler inlet LiBr solution enthalpy (Kcal/kg) | — | −30 | 35 | FIG. 7, point C, C' |
| Boiler inlet LiBr solution enthalpy/steam (Kcal/kg) | — | −30 × (1 + 6.56) = −227 | 45 × (1 + 6.56) = 344 | |
| Boiler outlet LiBr solution enthalpy (Kcal/kg) | — | 50 | 50 | FIG. 7, point B |
| Boiler outlet (steam + LiBr) solution enthalpy/steam (Kcal/kg) | — | −730 + 50 × 6.56 1058 | 1058 | |
| Boiler heat input/steam (Kcal/kg) | 730 − 50 = 680 | 1058 + 227 = 1285 | 1058 − 344 = 714 | |
| Thermal efficiency | 220/680 = 0.29 | 265/1285 = 0.21 | 265/793 = 0.37 | |

As will be seen from Table 1, the hybrid Rankine cycle system shown in FIG. 6 exhibits a thermal efficiency of 37% which is much higher than that (29%) of the conventional Rankine cycle system.

Figure 8:
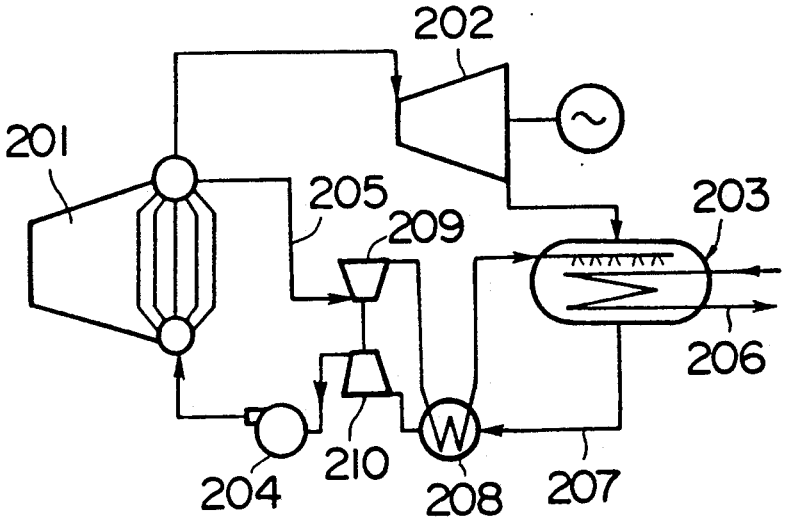

FIG. 8 shows a different embodiment which employs the same arrangement as the embodiment shown in FIG. 6, and further includes a liquid turbine 209 provided at an intermediate portion of a strong absorbent solution communication line 205 and a pump 210 disposed at an intermediate portion of a weak absorbent solution return line 207. The pump 210 is driven by the liquid turbine 209. In this embodiment, the combination of the liquid turbine 209 and the pump 210 provides about 70% of the power which is required for feeding the absorbent solution from the absorber condenser 206 into the boiler 201. In consequence, the capacity of the feed pump 204 can be reduced to about 30% of that of the feed pumps which are used in the embodiments shown in FIGS. 1 and 6.

Figure 9:
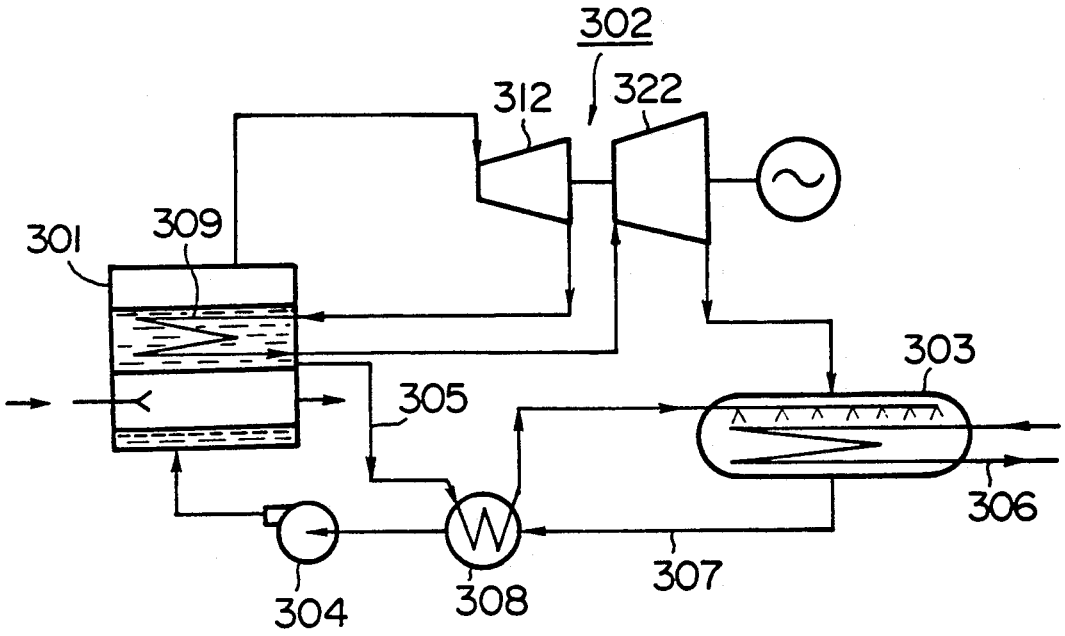
FIGS. 9 and 10 are block diagrams of different embodiments.
Figure 10:
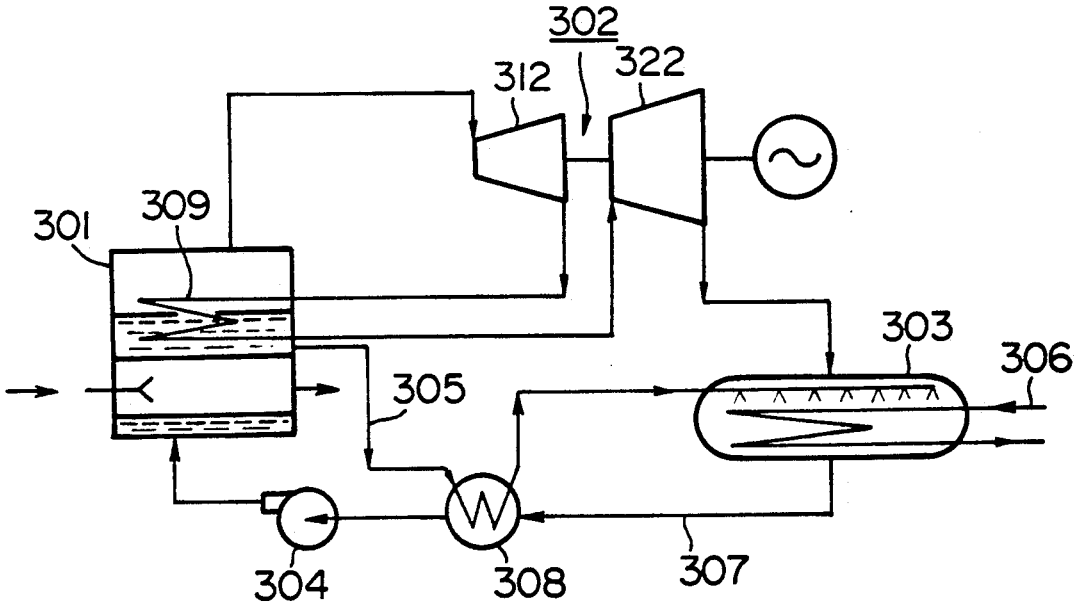

FIGS. 9 and 10 show different embodiments of the present invention which employ suitable countermeasures against erosion.

The embodiment of FIG. 9 has the substantially same arrangement as the embodiment shown in FIG. 6, except for the following point. Heat transfer tubes 309 are disposed in the boiler 301 such that they are completely immersed under the surface of the absorbent solution in the boiler 301, and the prime mover 302 is a multi-staged one which is composed of, for example, the high-pressure side 312 and the low-pressure side 322. As in the preceding embodiments, water is used as the working medium, while lithium bromide (LiBr) is used as the absorbent. The steam leaving the high-pressure side prime mover 312 is reheated in the heat-transfer tubes 309 and then fed forwards the low-pressure side prime mover 322. Namely, the steam 20 leaving the high-pressure side prime mover 312 with low temperature and pressure is returned to the boiler 301 and is made to flow through the heat-transfer tubes 309 so as to be reheated by the steam and lithium bromide solution of high temperature and pressure in the boiler 301. The steam thus reheated to a higher temperature flows into the low-pressure prime mover 322 and expands therethrough to produce a work outside. The steam with low temperature and pressure is then discharged into the absorber condenser 303. On the other hand, the lithium bromide solution condensed to a higher density in the boiler 301 flows into the absorber condenser 303 through the heat exchanger 308 and absorbs the steam coming from the low-pressure side prime mover 322 to become a weak lithium bromide solution. The weak lithium bromide solution is then returned to the boiler 301 through the heat exchanger 308 by means of the feed pump 304.

In the embodiment shown in FIG. 9, since the heat-transfer tubes 309 are immersed under the surface of the lithium bromide solution in the boiler 301, the steam to be supplied to the low-pressure side prime mover 322 can raise the temperature thereof substantially to the same level as the steam from the boiler 301. Accordingly a high level of dryness of steam is maintained at the outlet of the low-pressure side prime mover 322, thus eliminating any risk of erosion.

The temperature of the heat-transfer tube 309 is maintained in the substantially same low level as of the lithium bromide solution even though the flow rate of the steam circulating through the system is still low (at start-up). Therefore, the heat-transfer tubes are free from the problem of damage due to high temperature, so that the system can smoothly be started without substantial restriction in the starting condition. This shortens the start-up time, i.e., the time from the start till the steady operation, of the hybrid Rankine cycle system.

The heat-transfer tubes 309 may be arranged such that a part of these tubes is exposed above the surface of the lithium bromide solution (i.e., the steam atmosphere) as shown in FIG. 10. It is even possible that the entire part of the heat-transfer tubes 309 is disposed in the steam atmosphere in the boiler.

The advantage of the embodiment shown in FIG. 9 will be discussed in comparison with the arrangement which does not have the reheater heat-transfer tubes.

It is assumed that the concentration of lithium bromide of the lithium bromide solution supplied to the boiler 301 is 59%, while the lithium bromide concentration of the lithium bromide solution from the boiler 301 is 68%. It is also assumed that the pressure of the steam generated in the boiler 301 is 16 ata. The temperatures of the cooling water at the inlet and outlet of the cooling water lie 306 are assumed to be 36° C. and 42° C., respectively, while the temperature of the lithium bromide solution at the outlet of the absorber condenser 303 is 50° C. (see FIG. 2). Temperatures and pressures at various portions of the system operating under the above-described condition are shown in Table 2.

TABLE 2

| | |
|---|---|
| Pressure in boiler (pressure at inlet of high-pressure side prime mover 312) | 16 ata |

TABLE 2-continued

| | |
|---|---|
| Temperature of LiBr solution at boiler outlet (Temperature at inlet of high-pressure side prime mover 312) | 310° C. |
| Pressure at outlet of high-pressure side prime mover 312 | 1 ata |
| Temperature at outlet of high-pressure side prime mover 312 | 100° C. |
| Pressure at inlet of low-pressure side prime mover 322 | 1 ata |
| Temperature at inlet of low-pressure side prime mover 322 | 305° C. |
| Pressure at outlet of low-pressure side prime mover 322 | 0.01 ata |
| Temperature at outlet of low-pressure side prime mover 322 | 7° C. |
| Temperature of LiBr solution at outlet of absorber condenser 303 | 50° C. |
| LiBr solution temperature at boiler inlet | 260° C. |
| Dryness of steam at outlet of high-pressure side prime mover 312 | 0.94 |
| Dryness of steam at outlet of low-pressure side prime mover 322 | 0.92 |

Figure 11:
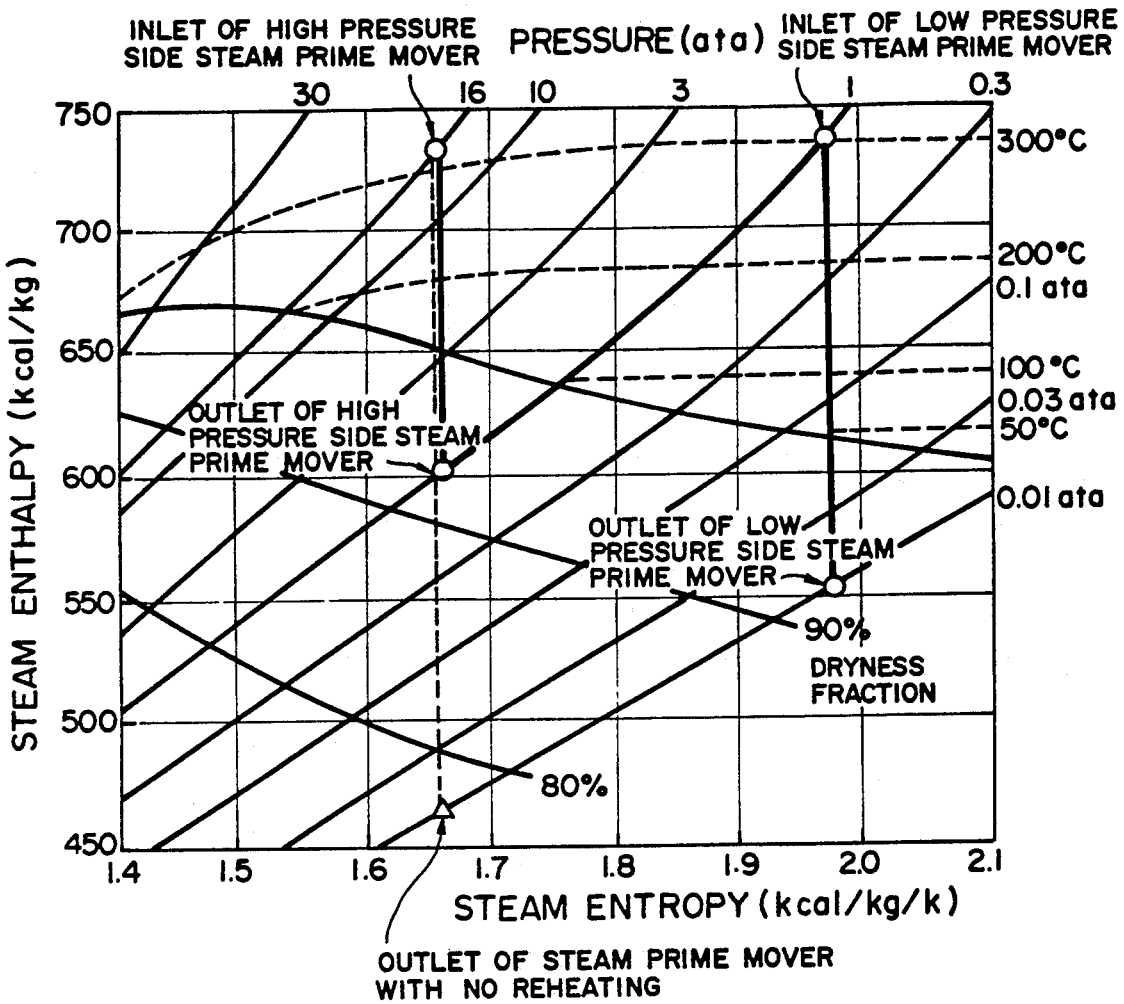
FIG. 11 is an Enthalpy-Entropy diagram of steam.

FIG. 11 shows an entropy-enthalpy diagram showing the state of the working medium in this embodiment by a solid line and another showing the states of working medium in a system without reheating by a broken-line.

As will be seen from Table 2 and FIG. 11, the dryness of the steam at the outlets of the high- and low-pressure prime movers 312 and 322 are theoretically 0.94 and 0.92, respectively. In contrast, the system without reheating theoretically exhibits a dryness of 0.78 which suggests a large tendency of erosion.

Figure 12:
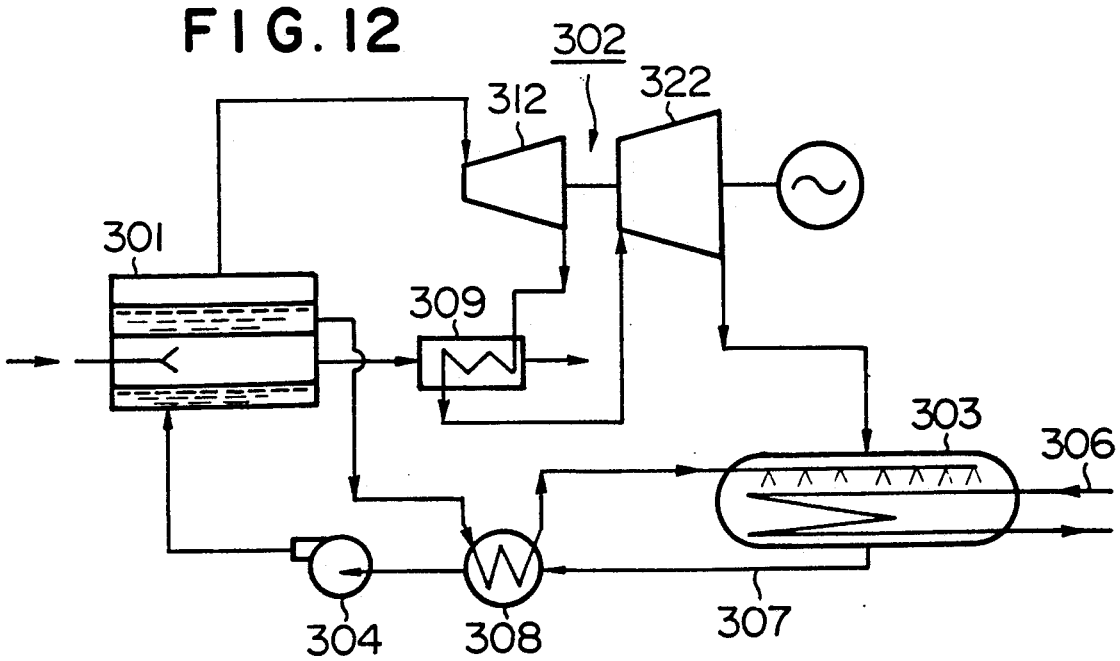
FIG. 12 is a block diagram of a comparison example.
Figure 13A:
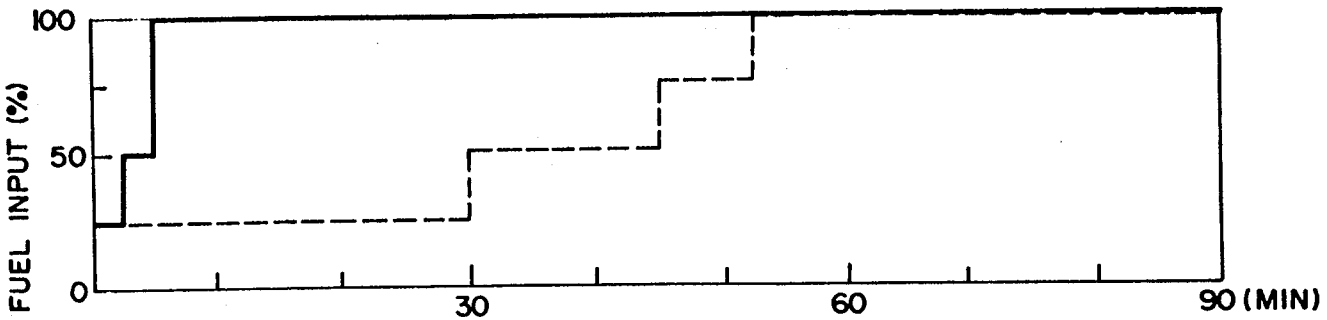
FIGS. 13A to 13C are diagrams showing secular changes in the operating conditions.
Figure 13B:
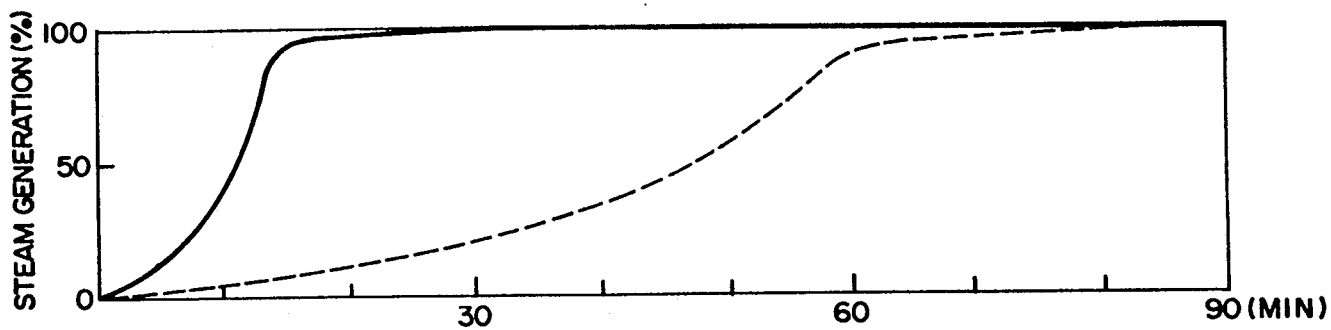
Figure 13C:
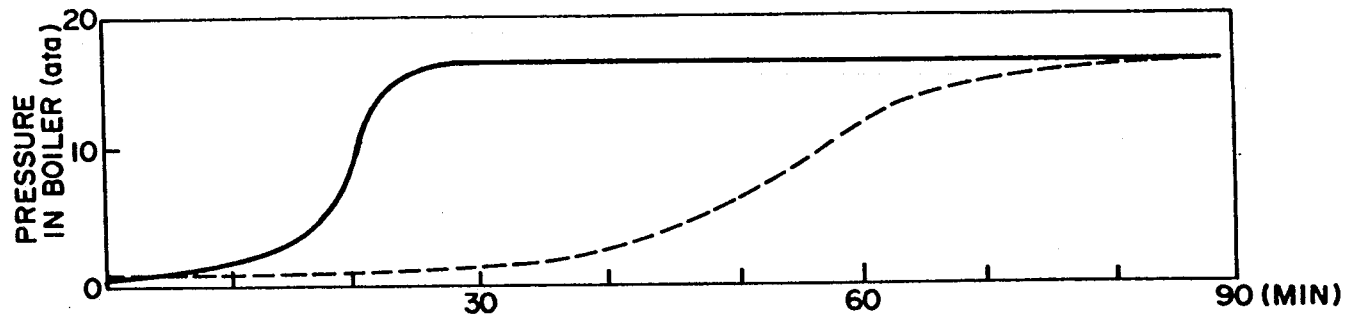

A description will be given hereinafter of the start-up time of the system of the described embodiment, in comparison with an arrangement shown in FIG. 12 in which the heat-transfer tubes 309 are disposed in a flow of combustion gas from the boiler, with specific reference to FIGS. 13A to 13C. They show, respectively, the rate of supply of fuel to the boiler, rate of generation of steam in the boiler and the internal pressure of the boiler in relation to the lapse of time. In the drawing, data concerning the embodiment of FIG. 9 and the data concerning the arrangement of FIG. 12 are shown by solid-line and broken-line, respectively. As will be send from FIGS. 13A to 13C, in the system embodying the present invention, the rate of supply of fuel reaches 100% in 5 minutes after the start of the system. In addition, the rate of supply of the fuel and the rate of generation of the steam reach the respective rated values thereof in 15 minutes and 25 minutes, respectively. In contrast, in the arrangement shown in FIG. 12, it takes about 50 minutes for the fuel supply rate to reach 100%. 60 minutes and about 65 minutes elapse to reach the rated values of the steam generating rate and the boiler internal pressure, respectively. As will be understood from these data, the system according to the present invention can be put to steady operation very quickly, thus remarkably shortening the start-up time.

Although the preceding embodiments make use of lithium bromide (LiBr) as the absorbent, this is only illustrative and the same advantages are brought about also when lithium chloride (LiCl) is used as the absorbent.

Figure 14:
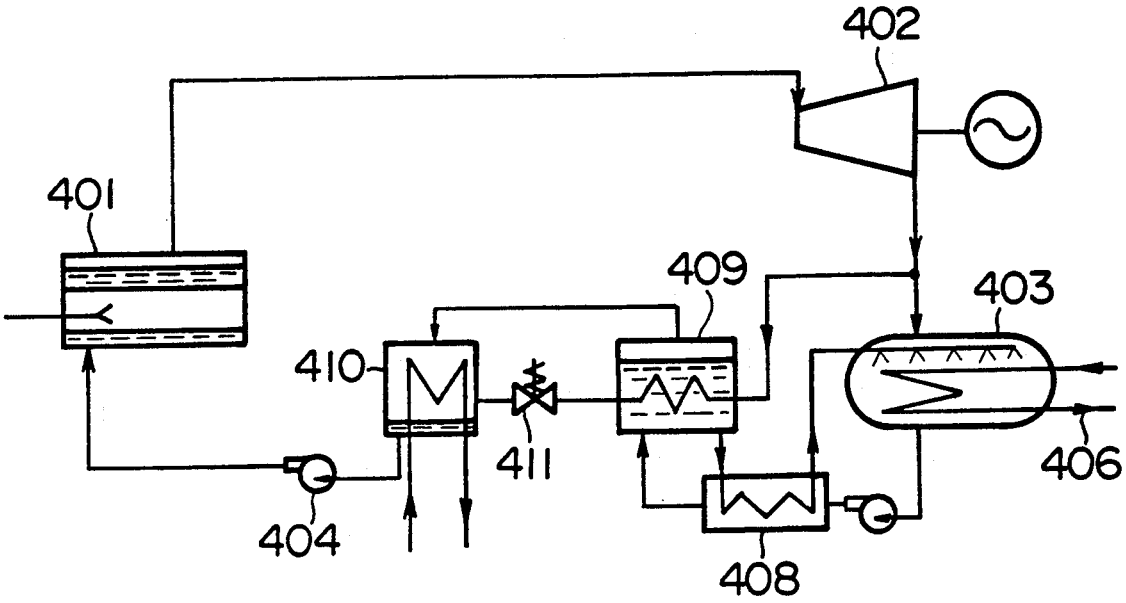
FIG. 14 is a block diagram of a different embodiment.

FIG. 14 shows a different embodiment which is suitable for use particularly when a large demand exists for preventing corrosion of a boiler by the working fluid.

In this embodiment, the absorbent solution which is corrosive is not supplied to the boiler but water (working medium) which has a small corrosion effect is supplied to a boiler 401, so that the corrosion of the structural members in the boiler 401 can effectively be avoided.

More specifically, in this embodiment, the absorbent solution from the absorber condenser 403 is introduced into a regenerator 409 through a heat exchanger 408, and heated and boiled by heat transferred from steam which is derived from a prime mover 402 through one or more branch lines. The steam generated as a result of boiling is introduced to a condenser 410 so as to be cooled and condensed into liquid phase. The strong absorbent solution generated as a result of boiling flows to the heat exchanger 408 and makes a heat exchange therein with the weak absorbent solution from the absorber condenser 403. The strong absorbent solution, thereafter, flows into the absorber condenser 406 where it absorbs the steam from the prime mover 402. In this case, the regenerator 409 serves as the separating means which separates the working medium vapor (steam) from the absorbent solution. The steam leaving the prime mover 402 and passing the branch lines is partly condensed into liquid phase due to heat absorption in the regenerator 409 and is introduced through a pressure regulator valve 411 into the condenser 410 so as to be fully condensed. The water generated in the condenser 410 and the water supplied from the outside are fed back to the boiler 401 by means of the feedwater pump 404.

In the embodiment shown in FIG. 14, the steam to be supplied to the regenerator 409 is extracted from a line through which the steam from the prime mover 402 flows. This, however, is not exclusive and the steam may be extracted from an intermediate portion of the prime mover 402. In the case where the temperature of the steam flowing into the absorber condenser 403 is lower than the temperature of the cooling water in the cooling water line 406, the steam to be supplied to the absorber condenser 403 may be extracted from an intermediate portion of the prime mover 402, while the steam to bed supplied to the regenerator 409 may be derived from the outlet of the prime mover 402.

In this embodiment, fluid to be supplied to the boiler 401 is water but not the absorbent solution, so that the boiler 401 is protected against corrosion which otherwise maybe caused by the absorbent solution. Therefore, the steam from the boiler 401 can have a sufficiently high pressure, so that the output efficiency of the prime mover, which is given as the ratio of the output power of the prime mover to the heat input to the boiler, can be increased as compared with conventional system.

Figure 15:
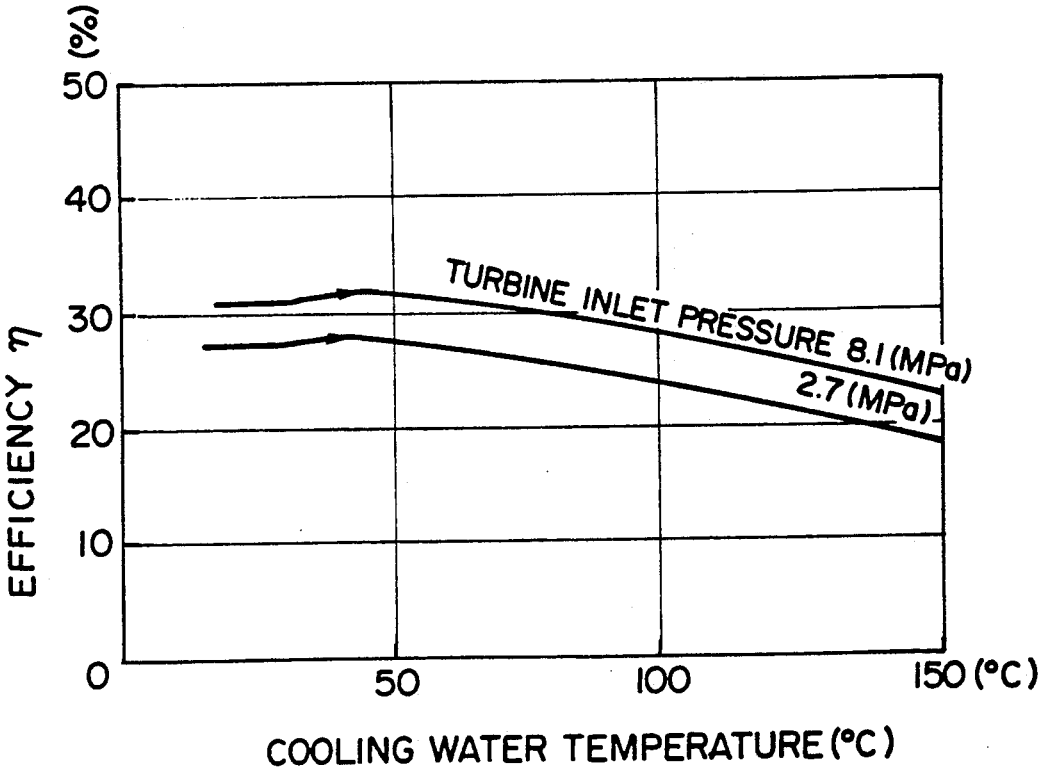
FIGS. 15 to 17 are diagrams showing changes in electric power generating efficiency as obtained under different operating conditions.

FIG. 15 shows how does the electric power generating efficiency of this system change in relation to a efficiency of this system change in relation to a change in the cooling water temperature in the absorber condenser 403 and to a change in the steam pressure at the inlet of the prime mover (steam turbine) 402, on assumptions that the steam temperature at the inlet of the steam turbine 402 is 500° C. and that the concentrations of LiBr in the absorbent solution in the absorber condenser 403 and in the regenerator 409 are 55% and 60%, respectively.

Figure 16:
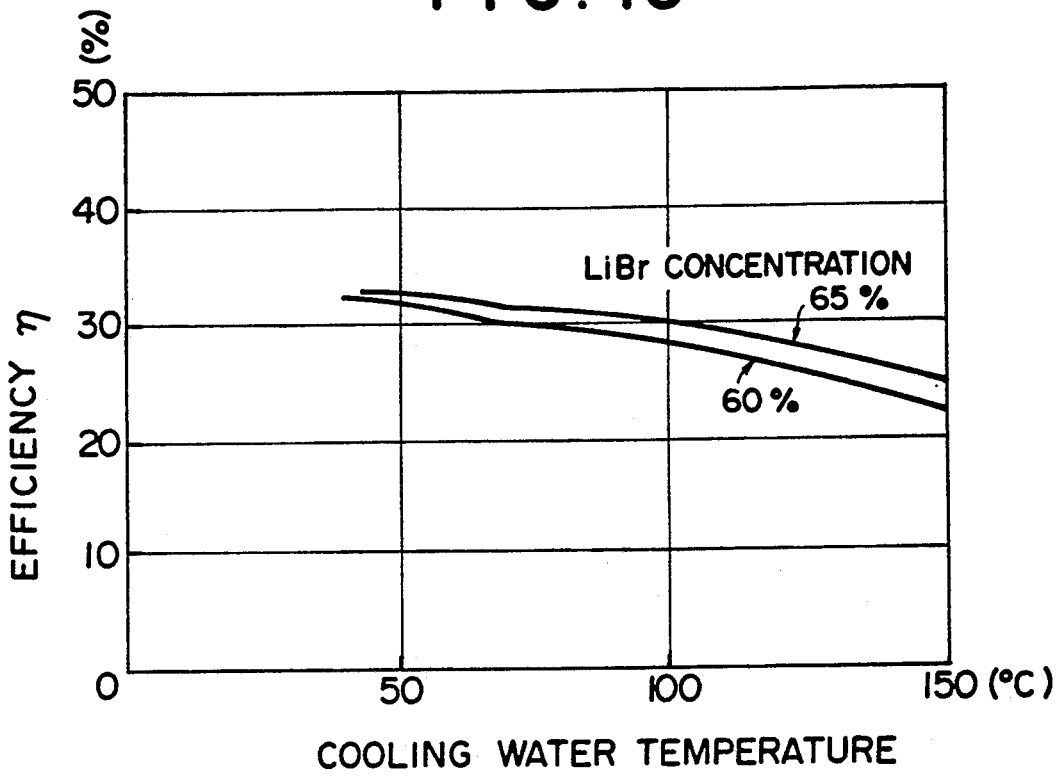

FIG. 16 shows the manner how the electric power generating efficiency is changed in this embodiment in relation to a change in the lithium bromide concentration in the regenerator 409, as observed when the difference in the lithium bromide concentration between the solution in the absorber condenser 403 and the solution in the regenerator 409 is 5% while the temperature and pressure of the steam at the inlet of the turbine are 500° C. and 8.1 MPa, respectively. It will be seen that the electric power generating efficiency is increased as the concentration of lithium bromide is increased.

Figure 17:
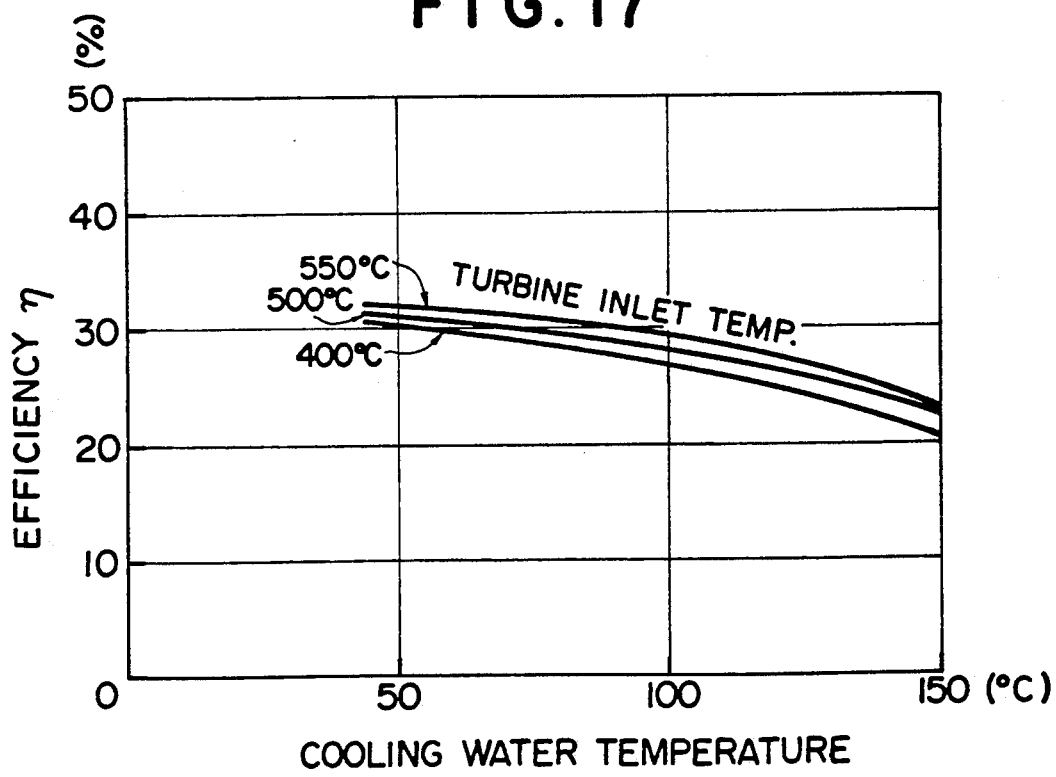

FIG. 17 shows the manner how the electric power generating efficiency is changed in this embodiment in relation to a change in the steam temperature at the turbine inlet as observed when the lithium bromide concentrations in the solutions in the absorber condenser 403 and the regenerator 409 are 55% and 60%, respectively, while the steam pressure at the turbine inlet is 8.1 MPa. It will be understood that the power generating efficiency is increased in accordance with a rise in the steam temperature at the turbine inlet.

Although the embodiment has been described with reference to a case where the working fluid is composed of (water) steam as working medium for driving the prime mover (turbine) and of aqueous solution of lithium bromide (LiBr) as absorbent solution, this is only illustrative and the same advantages can be brought out by the combination of steam and aqueous solution of lithium chloride (LiCl).

Figure 18:
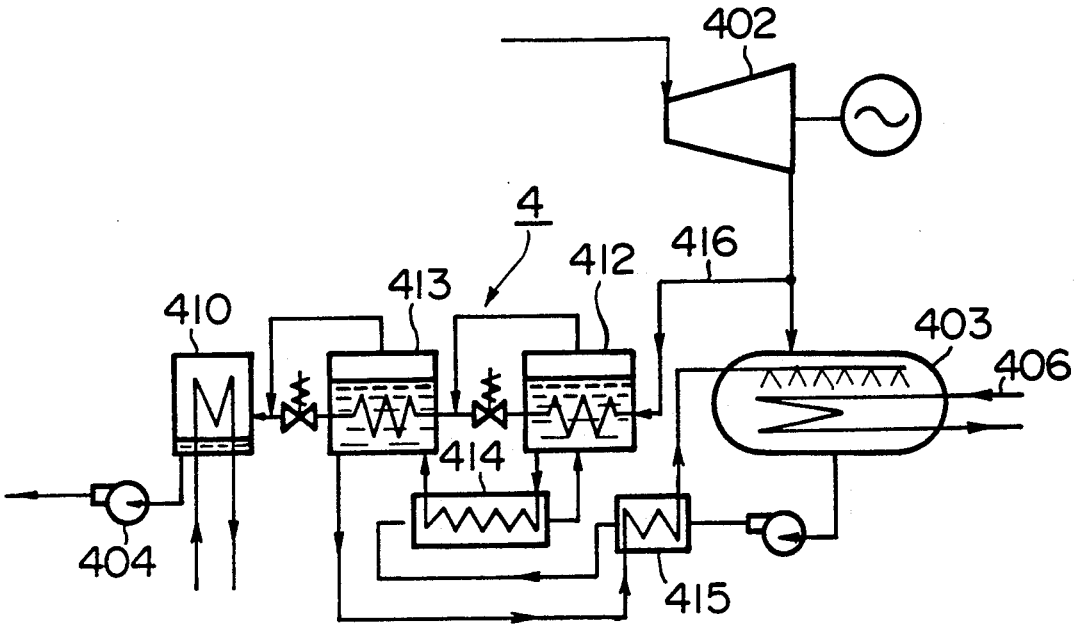
FIGS. 18 to 22 are block diagrams of different embodiments.

FIG. 18 shows a different embodiment of the present invention which employs a plurality of regenerators. In the illustrated cases, there is regenerator means 4 consisting of two regenerators 412 and 413 connected in series. This embodiment also employs heat exchangers 414 and 415 corresponding to the regenerators 412 and 413. In this embodiment, by virtue of the use of a multiple of combinations of regenerator and heat exchanger, the separation of the steam from the absorbent solution is effected in two stages by means of the regenerators 412 and 413 even when the flow rate of the steam flowing through the branch line 416 is small, so that the output efficiency (electric power generating efficiency) of the prime mover 402 can be increased advantageously.

Figure 19:
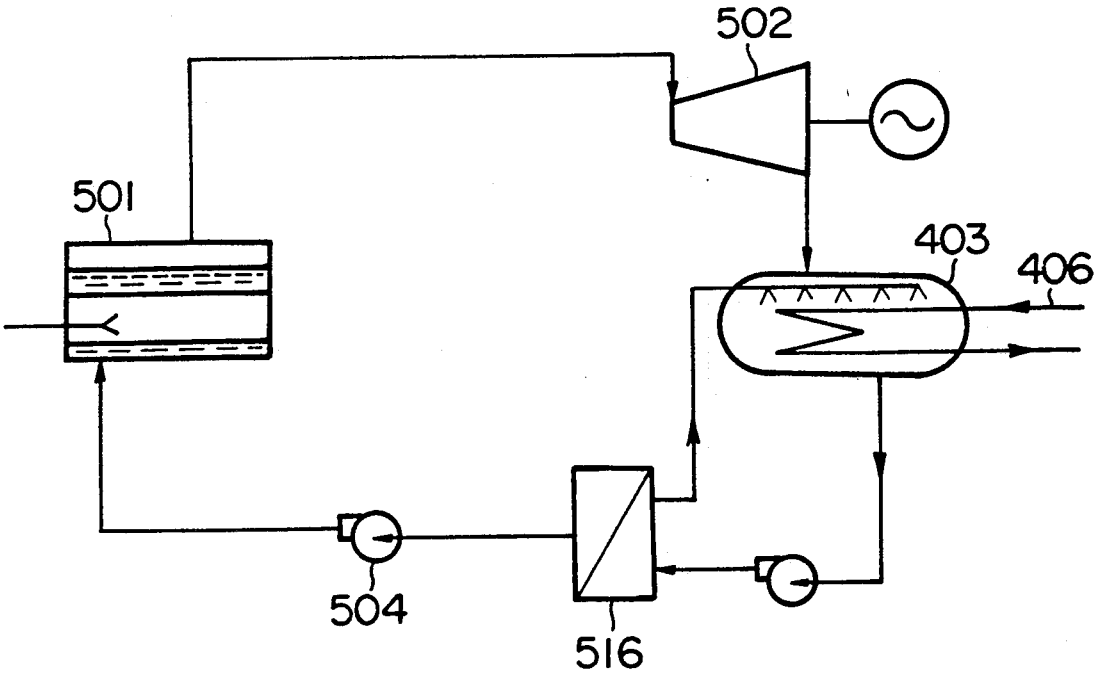

FIG. 19 shows a different embodiment in which a reverse osmosis device 516 is used in place of the regenerator as the separation means for separating the working medium vapor and the absorption solution from each other. The reverse osmosis device 516 serves to separate water from the absorbent solution leaving the absorber condenser 403. The water thus separated is supplied to the boiler 501 by means of a feed pump 504, while the strong absorbent solution separated and remained in the reverse osmosis device 516 is returned to the absorber condenser 403 to absorb the working medium vapor form the prime mover 502. Thus, the embodiment shown in FIG. 19 ensures a high electric power generating efficiency while overcoming the problem of corrosion of the boiler 501. In order to separate and extract water from the absorbent solution by the action of the revere osmosis device 516, it is necessary to apply a high pressure to the absorbent solution. The pressure is about 100 MPa when the concentration of lithium bromide in the absorbent solution is about 60%.

Figure 20:
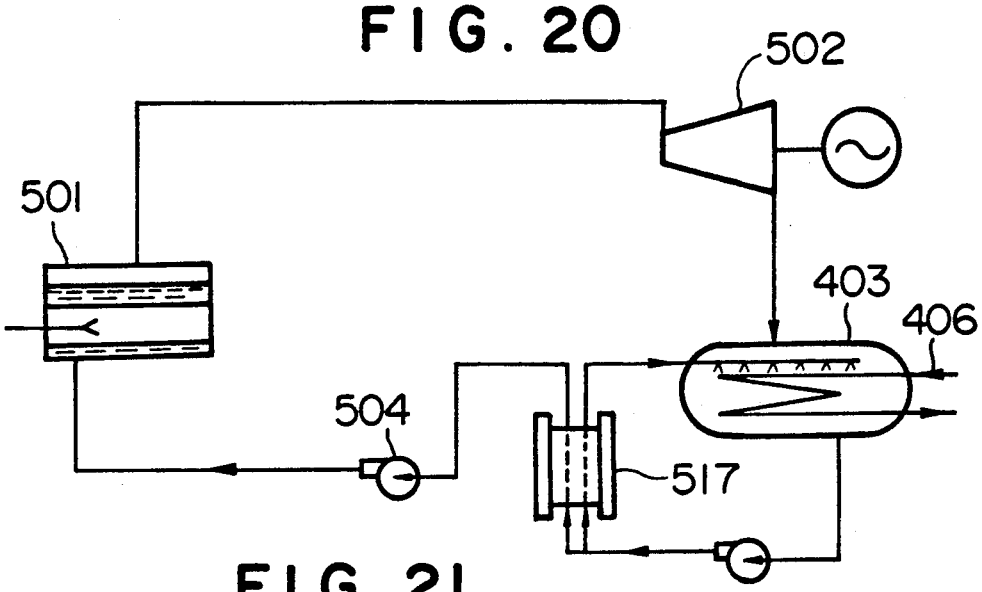

FIG. 20 shows a different embodiment which employs an electric dialyzer 517 in place of the reverse osmosis device 516, for the purpose of separation of water from the absorbent solution leaving the absorber condenser 403. This embodiment offers, like as in the case of the embodiment incorporating the reverse osmosis device 516, a high electric power generating efficiency while suppressing corrosion of the boiler 501.

Figure 21:
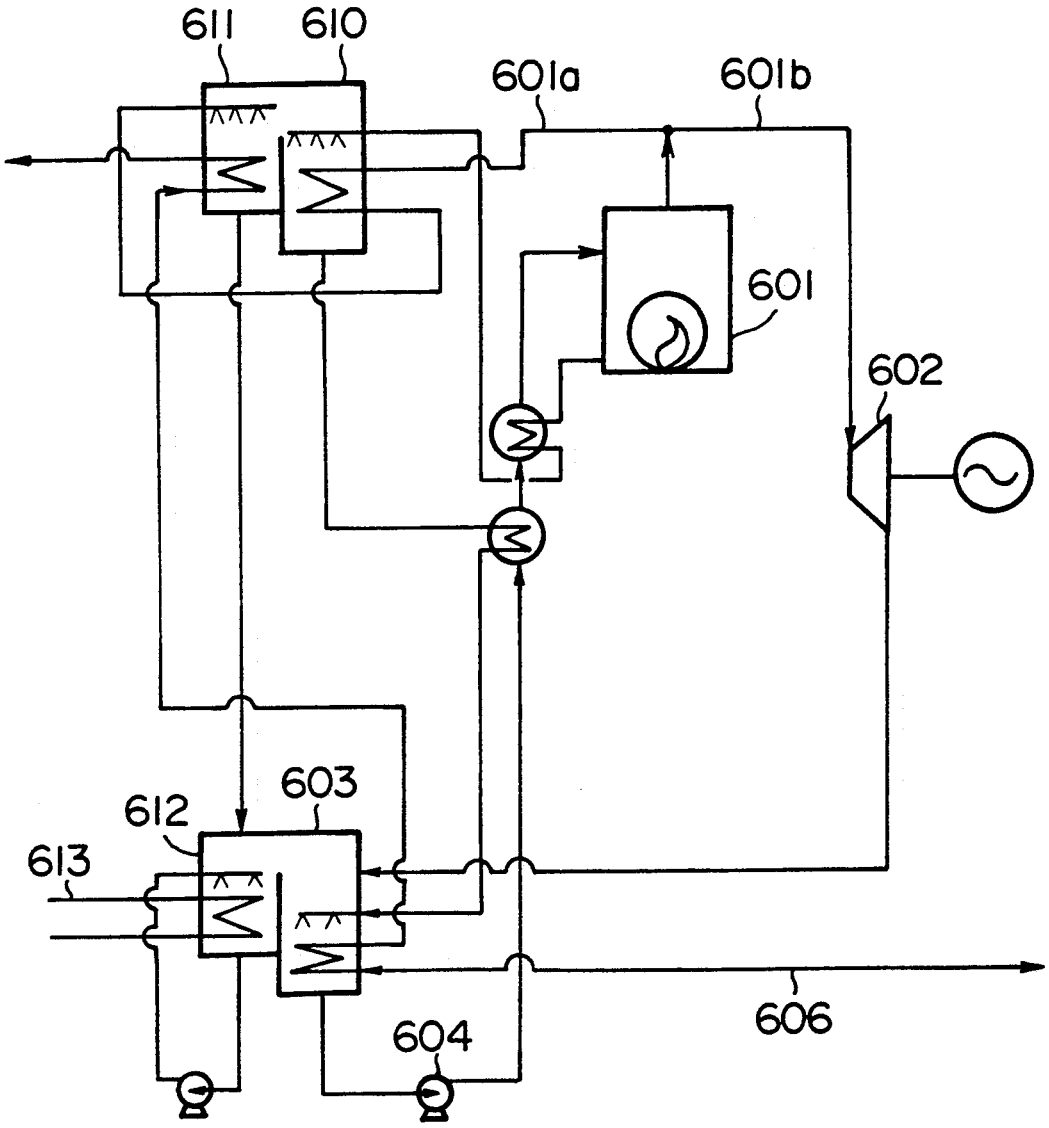

FIG. 21 shows a different embodiment in which a weak solution is heated in a high-temperature regenerator 601 so as to be divided into steam and strong absorbent solution. A part of the steam flows through a steam line 601*a* into a low-temperature regenerator 610 and generates therein steam and condenses into water in a condenser 611, which is heated and evaporated again by the chilled water flowing through an evaporator 612. The steam generated in the evaporator 612 is absorbed and condensed by the strong solution in an absorber 603 connected to the evaporator 612. In consequence, a vacuum on the order of 5 mmHg or so is maintained within the evaporator 612 and the absorber 603.

The condensate is then fed into the high-temperature regenerator 601 by means of the pump 604. The other part of the steam generated in the high-temperature regenerator 601 flows into a steam turbine 602 through the steam line 601*b* and expands therethrough to produce a work outside while reducing its pressure. The steam thus expanded is then directly introduced into the absorber 603 so as to be absorbed and condensed by the solution.

As will be understood from the foregoing description, in the embodiment shown in FIG. 21, the steam passing through the steam line 601*a* circulates through an absorption type refrigeration cycle which generates and supplies chilled water 613. The steam passing through the steam line 601*b* drives the steam turbine 602 to produce electric power. Both steam passing through the lines 601*a* and 601*b* is absorbed and condensed in the absorber 603.

thus, in this embodiment, the amounts of the chilled water and electric power can be changed as desired by controlling the flow rates of steam in the steam lines 601*a* and 601*b* according to the demands.

The system of this embodiment can be obtained simply by incorporating a combination of a steam turbine and a generator in absorption refrigeration system, so that the system can have quite a simple construction which is very easy to maintain and inspect.

Figure 22:
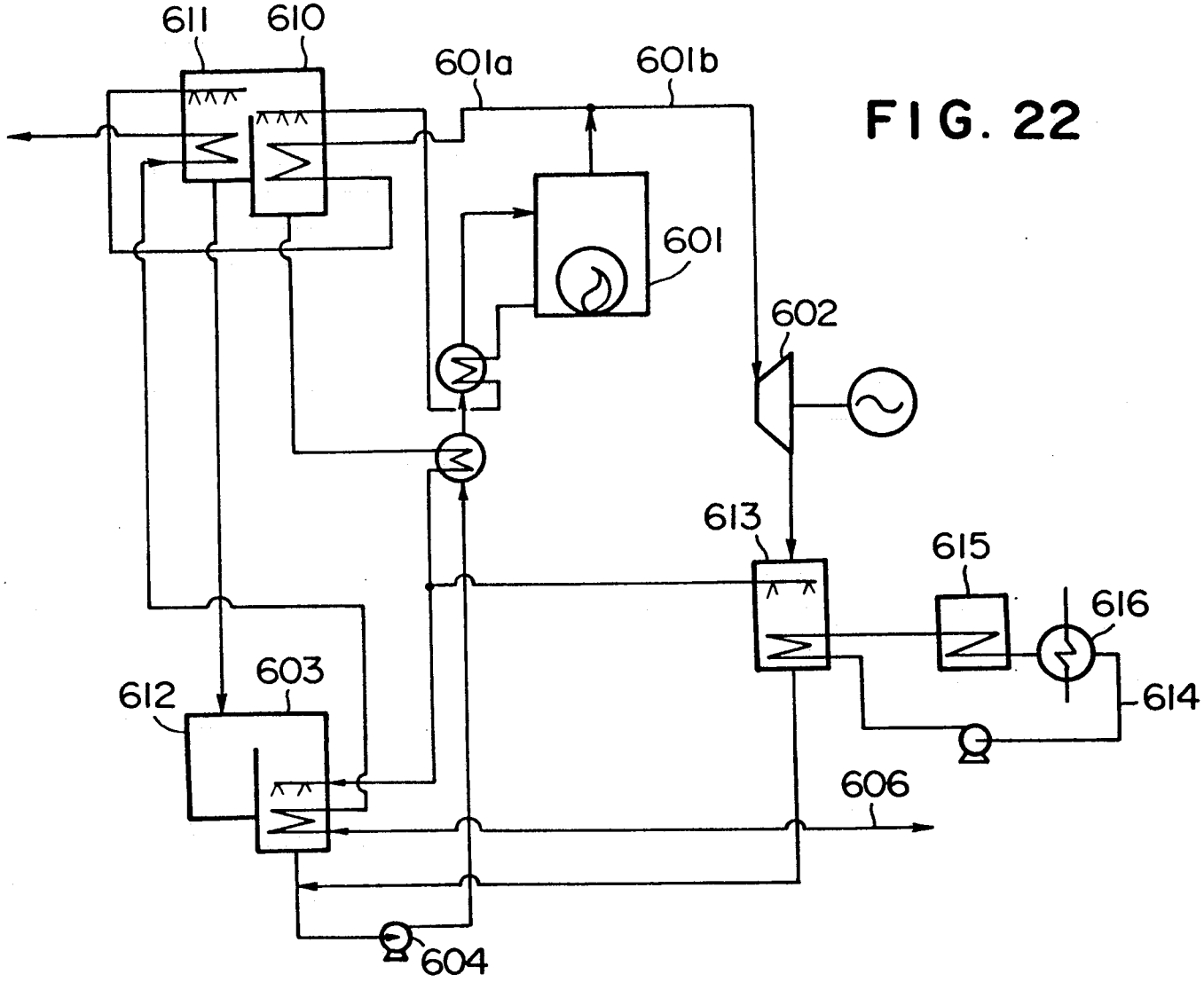

FIG. 22 shows a different embodiment of the present invention in which an absorber condenser 613 different from an absorber of a refrigeration cycle is provided on the back-pressure side, i.e., discharge side, of the steam turbine shown in FIG. 21. This absorber condenser 613 is provided for an intention of converting a greater part of the energy of steam into heat energy instead of converting into mechanical or electrical energy. More specifically, in this embodiment, the temperature of cooling water flowing in the heated water cycle 614 is set at about 80° C. so that the ratio of the energy converted into electrical power by the turbine 602 is reduced while allowing the energy of the exhaust steam from the turbine to be taken out as heated water of 80° C. The heat energy possessed by this heated water is recovered through a separate refrigerator 615 or a heated-water heat exchanger 616, whereby most part of the heat energy of the steam is efficiently utilized.

What is claimed is:

1. A hybrid Rankine cycle system, comprising:

separating means including a heating device for separating working medium steam from weak absorbent solution including said working medium and a substance having a boiling point higher than a heating temperature in said heating device, thereby leaving a strong absorbent solution, said substance being selected from the group consisting of alkali metal halides and alkali earth metal halides;

wherein said separating means includes a boiler for heating said weak absorbent solution to separate said steam and said strong absorbent solution therefrom;

a steam driven prime mover through which said steam from said separating means expands to produce work outside, wherein said prime mover is a multiple-stage turbine, and said system includes heat transfer means disposed within said separating means for transferring heat from steam and/or said strong absorbent solution in said separating means to steam passing out from one stage of said turbine, and wherein the steam from said heat transfer means is delivered into a next stage of said turbine;

an absorber condenser means for introducing thereinto said strong absorbent solution to absorb into steam from said prime mover to produce said weak absorbent solution;

means for delivering said weak absorbent solution towards said separating means; and means for delivering said strong absorbent solution from said separating means towards said absorber condenser means.

2. A hybrid Rankine cycle system according to claim 1, wherein said heat transfer means includes at least one heat transfer pipe.

3. A hybrid Rankine cycle system according to claim 1, wherein said substance is lithium bromide or lithium chloride or calcium chloride.

4. A hybrid Rankine cycle system, comprising:

boiler means for generating working medium steam;

a steam driven prime mover through which said steam from said boiler means expands to produce work outside;

an absorber condenser means for introducing thereinto strong absorbent solution to absorb said steam from said boiler means to produce weak absorbent solution including said working medium steam and a substance selected from the group consisting of alkali metal halides and alkali earth metal halides;

separating means for separating working medium condensate and said strong absorbent solution from said weak absorbent solution, wherein said separating means includes regenerator means for heating said weak absorbent solution to separate it into strong absorbent solution and steam, and said system further includes a condenser for condensing said steam from said regenerator means into condensate to be fed to said boiler means, and wherein said strong absorbent solution is introduced into said absorber condenser means from said regenerator means;

means for delivering said strong absorbent solution towards said absorber condenser means; and means for delivering said working medium condensate towards said boiler means.

5. A hybrid Rankine cycle system according to claim 4, wherein said regenerator means includes a plurality of regenerators disposed in series.

6. A hybrid Rankine cycle system according to claim 4, wherein said substance is lithium bromide or lithium chloride or calcium chloride.

7. A hybrid Rankine cycle system comprising:

boiler means for separating working medium steam from a weak absorbent solution including said working medium and a substance selected from the group consisting of alkali metal halides and alkali earth metal halides, said substance have a boiling point higher than a heating temperature in said boiler means, thereby leaving strong absorbent solution;

a steam driven prime mover through which said steam from said boiler means expands to produce work outside;

an absorber condenser means for introducing thereinto said strong absorbent solution to absorb said steam from said prime mover to produce said weak absorbent solution;

a pump disposed in a flow of said weak absorbent solution for delivering said weak absorbent solution towards said boiler means;

means for delivering said strong absorbent solution from said boiler means towards said absorber condenser means; and a fluid driven turbine disposed in a flow of said strong absorbent solution for driving said pump.

8. A hybrid Rankine cycle system according to claim 7, wherein said substance is lithium bromide or lithium chloride or calcium chloride.

* * * * *